United States Patent [19]

Gallis

[11] 4,350,318

[45] Sep. 21, 1982

[54] TIE PLATE

[75] Inventor: Anthony J. Gallis, Lake Hiawatha, N.J.

[73] Assignee: Harsco Corporation, Camp Hill, Pa.

[21] Appl. No.: 225,202

[22] Filed: Jan. 15, 1981

[51] Int. Cl.[3] ..... E04G 17/02; E04G 17/08

[52] U.S. Cl. ..... 249/40

[58] Field of Search ..... 249/18, 25, 26, 33, 249/38, 40, 44, 45, 47, 205, 207, 211, 219 R, 219 W, 190–192, 189, 213, 216, 41, 42, 46, 217, 214; 248/228, 226.3; 182/179; 269/43, 243; 24/263 A; 52/584, 721; 403/387, 400

[56] References Cited

U.S. PATENT DOCUMENTS

| | | | |
|---|---|---|---|
| 871,390 | 11/1907 | Dietrichs | 249/216 |
| 1,299,868 | 4/1919 | Steinheiser | 403/387 |
| 1,978,896 | 10/1934 | Schwaab | 249/218 |
| 2,162,349 | 6/1939 | Hillberg | 249/213 |
| 2,631,352 | 3/1953 | Williams | 25/131 |
| 2,736,527 | 2/1956 | Maier | 248/228 |
| 2,960,743 | 11/1960 | Arrighini | 249/219 W |
| 2,976,597 | 3/1961 | Elam | 249/47 |
| 3,053,494 | 9/1962 | Stoll | 248/228 |
| 3,067,479 | 12/1962 | Schimmel | 249/45 |
| 3,141,224 | 7/1964 | Gates | 25/131 |
| 3,899,152 | 8/1975 | Avery | 249/18 |
| 3,927,858 | 12/1975 | Underhill | 249/40.46 |
| 3,972,501 | 8/1976 | Plough | 249/42 |
| 3,984,079 | 10/1976 | Gates | 249/42 |
| 4,033,544 | 7/1977 | Johnston | 249/40 |
| 4,068,818 | 1/1978 | Gates | 249/42 |
| 4,147,322 | 4/1979 | Dahlstrom | 249/40 |
| 4,192,481 | 3/1980 | Durbin | 249/219 R |
| 4,219,180 | 8/1980 | Strickland | 249/219 R |

FOREIGN PATENT DOCUMENTS

| | | |
|---|---|---|
| 1158041 | 7/1969 | United Kingdom . |
| 1553104 | 9/1979 | United Kingdom . |

*Primary Examiner*—Willard E. Hoag

*Attorney, Agent, or Firm*—Curtis, Morris & Safford

[57] ABSTRACT

A concrete wallform system comprises a vertical waler (formed of a pair of spaced channel beams bolted back to back) for stiffening the horizontal joists, which in turn back the forming panels, and a tie rod extending between the channel beams, and a tie connector plate connecting the tie rod to the waler. The connector plate is formed as a flat plate with an aperture approximately at the center and a hook portion along one edge thereof. The hook portion overfits a lip on one wall of one of the channel beams. A bolt clip near the other edge of the flat plate fastens the connector plate to a lip of a corresponding wall of the companion channel beam. This bolt clip is standard hardware of the type used on aluminum joists (e.g., to join the waler to the joists). A wing nut disposed at the aperture stresses the tie rod so that when wet cement is poured into the wallform, forces that are transmitted through the wallform to the waler are taken up by the tie rod. Preferably, a raised spacer portion is provided on the back surface of the connector plate to aid in maintaining the spacing between the channel beams of the waler and for locking the hook portion on its respective channel flange.

15 Claims, 3 Drawing Figures

TIE PLATE

FIELD OF THE INVENTION

This invention relates to wallforms, especially those suitable for use in fabricating concrete walls. In particular, this invention relates to tie connector plates to be mounted on walers, or strongbacks, of a wallform system for joining tie rods to such walers, etc.

BRIEF DESCRIPTION OF THE PRIOR ART

Wallforms for forming a large poured concrete wall generally comprise a pair of opposed panels rigidly buttressed by a support structure including, for example, joists backed by walers arranged perpendicularly to the joists.

The sheathing panels, which are typically made from plywood, may alternatively include fiberglass panels and other non-wood panels (especially where special architectural effects are desired).

The panels may be held apart by separator blocks which can be removed as the concrete is poured into the wallform. However, to oppose the outward pressure of the wet concrete against the panel forms, tie rods preferably are used and each extends through the paneling from a waler on one side to a corresponding waler on the other side. Tie rod couplers, usually in the form of metal plates functioning essentially as washers, are positioned on the free side of the walers to receive the ends of the tie rods.

Usually, the tie rods are threaded, and the wall-forming void can be adjusted by turning a wing nut against the plate. See typical prior art shown in *Formwork for Concrete* by M. K. Hurd, 2nd edition (1969, American Concrete Institute) at FIGS. 4–11, 9–22, and 9–31 (and accompanying text). Over the years several variations have been proposed; e.g., see U.S. Pat. Nos. 3,984,079; 3,927,858; and 3,899,152 (FIG. 11).

In recent decades, particularly for larger construction jobs, the support structure for the paneling has been formed of metal beams rather than conventional wooden beams. In order to facilitate nailing, a wood or woodlike nailer strip is frequently incorporated into a portion of the metal joists. When extruded from aluminum, conventional bolt channels are often included in the flange of the I-beam joists (opposite the flange carrying the wooden nailer strip) to facilitate the use of bolts in connecting the aluminum joists to other equipment.

Particularly in the aluminum beam systems, the tie connector plate has been fastened by means of bolts inserted in bolt channels of the waler beams (see, for example, U.S. Pat. Nos. 4,192,481 and 4,033,544). This makes the tie connector plates somewhat difficult to install, quite troublesome to adjust one in place, and require many loose parts (in contrast to the prior simple washer-like flat connector plates).

The tie connector plate is typically a necessary element for the assembly of a double-channel waler and often has to be bolted to the waler channels prior to erection of the system. This can make subsequent adjustment of the position of the tie coupler plate very difficult. Such plates sometimes are even tack welded in place.

OBJECTS AND SUMMARY OF THE INVENTION

Accordingly, it is an object of this invention to provide a wallform system that incorporates a tie connector plate avoiding the drawbacks of prior wallform systems.

More specifically, it is an object of this invention to provide a tie connector plate formed of a simple construction and which is easily installed and adjusted on a waler, and yet does not need a tie rod for affixing in place nor yet to be inflexibly positioned along the waler by welding.

It is a further object to provide a tie connector plate suitable for use with a waler formed of back-to-back U-shaped channel beams.

In this connection, it is an object of this invention to provide a tie connector plate that additionally assists these channel beams in maintaining their predetermined separation from one another, and also aids in localized stiffening thereof at the point of maximum stress.

According to a preferred embodiment of this invention, such a tie connector plate comprises a flat plate with a central aperture for accommodating a tie rod therethrough. A hook portion is formed along one edge facing inwardly. In other words, the hook portion forms an interior hook opening towards said aperture. The hook portion is preferably formed integrally with the flat portion.

A fastening means comprising a bolt hole can be provided near the opposite edge so that a bolt clip can be attached to the back of the flat portion.

This tie connector plate is adapted to be used in a wallform system in which the waler is constructed of back-to-back U-shaped channel beams. Lips can optionally be provided on the outward facing side walls of the channel beams for further stiffening. The hook portion of the tie connector plate is dimensioned to be hooked over the end of the outer flange (and of any lip thereon) of one such beam. The bolt clip can be used to fasten the tie connector plate to the lip at the end of the other outer flange of its companion channel beam. A raised spacer portion is preferably provided on the back of the connector plate, advantageously with the aperture centered therein, to aid in maintaining the spacing between the channel beams. This spacer also obviates the need for using an inner lip on the hook portion, if one wishes to add security against the connector plate shifting relative to the outer flanges of the channel beams.

The pairs of channel beams typically are joined by at least one row of bolts each having a tubular spacer, as has been done in the past. Two rows of bolts are needed, if the channel web (i.e., base) is wide; such as on the order of 8 inches.

In this specification and the accompanying drawings, I have shown and described preferred embodiments of my invention and have suggested various alternatives and modifications thereof; but it is to be understood that these are not intended to be exhaustive and that many other changes and modifications can be made within the scope of the invention. These suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION

Figure 1:
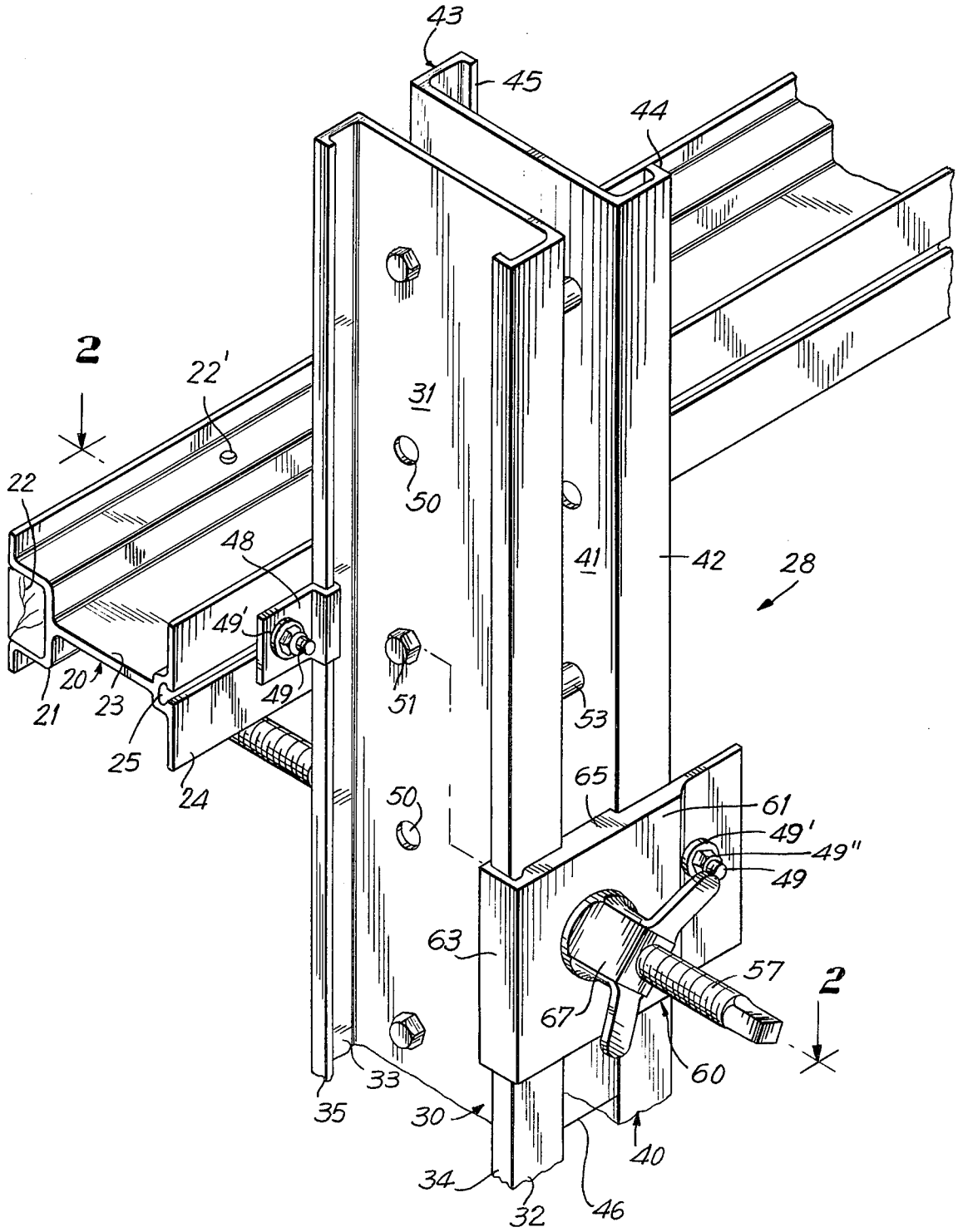
FIG. 1 is an isometric view of a portion of a wallform system showing a preferred embodiment of the tie connector plate according to this invention.
Figure 2:
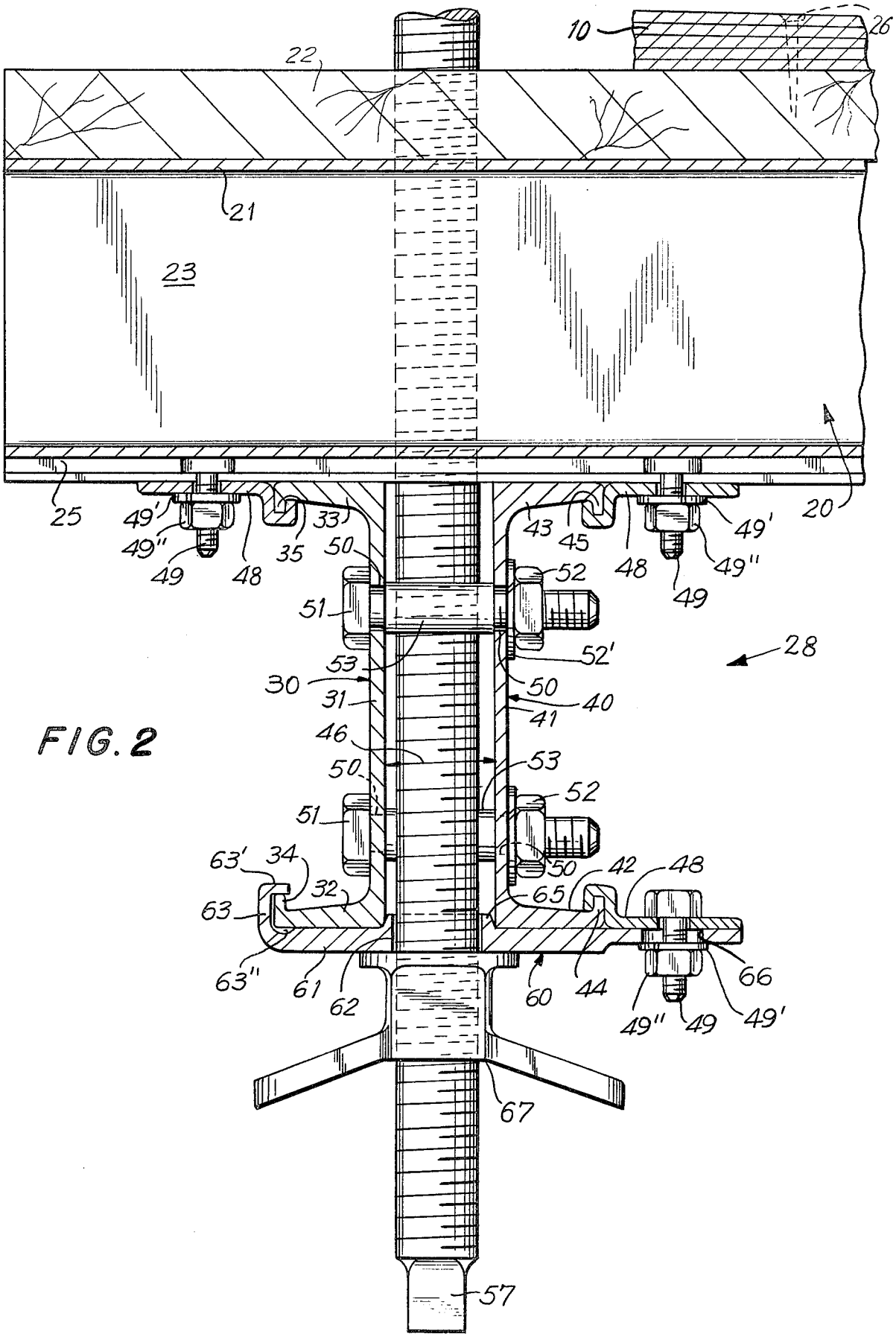
FIG. 2 is a sectional view of the wallform system along the line 2—2 of FIG. 1.

FIGS. 1 and 2 illustrate a preferred embodiment of a wallform structure incorporating the disclosed unique coupler plate embodying the present invention. As shown in FIG. 2, the wallform comprises a panel or sheathing 10, which can be plywood, backed by a plurality of aluminum joists 20.

Each of the joists 20 is arranged as a modified aluminum I-beam (with a top-hat section 21 abutting the sheathing, with a wooden nailer strip 22 secured in the top-hat section 21 by screws 22', a web 23, and a second flange 24 having a T-slot or bolt channel 25 extending the length thereof). Generally, if plywood sheathing 10 is used, the sheathing can be nailed to the nailer strip 22 (see nail 26 in FIG. 2). The aluminum joists 20 are in turn supported by a waler arrangement formed of a plurality of vertical walers, a portion of a typical one of which is illustrated.

In this embodiment, the vertical waler assembly 28 is formed of a left-hand channel beam 30 coupled in back-to-back arrangement with a right-hand channel beam 40. Here the left-hand channel beam 30 has a base or web portion 31, two parallel sides (i.e., outer flange 32 and inner flange 33), and corresponding lips 34 and 35 on the respective flanges 32 and 33 directed toward one another at the open side of the channel beam 30.

Similarly, the right-hand channel beam 40 has a base or web portion 41, two parallel sides (or outer flange 42 and inner flange 43), and corresponding lips 44 and 45.

Here the channel beams 30 and 40 are affixed to one another so that there is a gap 46 between the webs 31 and 41.

Bolt clips 48 are hooked over the lips 35 and 45 and are bolted into bolt channel 25 by means of bolts 49 to secure the vertical waler 28 to the aluminum joist 20.

Two parallel rows of bolt holes 50 are provided in the bases 31 and 41 of the channel beams 30 and 40. Bolts 51 are inserted in the holes 50 and are fastened down by means of nuts 52. Spacers 53 overfit the bolts 51 between the bases 31 and 41 to maintain the gap 46 at a predetermined spacing. For purposes of illustration, bolts 51 have been shown closer than is normal.

Although not illustrated in the drawings, where appropriate, washers can be used with the bolts 51. Instead, a lock washer 52' has been shown in FIG. 2.

A tie rod 57, which is here illustrated as a threaded bar, is anchored at an anchor point behind the sheathing 10, passed through a closely fitting hole in the sheathing 10, and extends between the joists 20 and through the gap 46 between the channel beams 30 and 40. The anchor point can be against a similar waler in an opposed corresponding wallform, in an opposed pre-cast concrete facing, or the like.

A tie connector plate 60 is mounted on the vertical waler channels 30, 40 and functions to take up stress transmitted by the tensioned tie 57 when liquid concrete is poured into a wallform assembly (comprised for example of two spaced wallforms).

In the illustrated tie connector plate, a flat plate portion 61 extends from a left side to a right side thereof as viewed in FIGS. 1 and 2 so as to span the flanges 32 and 42. An aperture 62, through which the tie 57 passes, is bored through the flat portion 61 at a position corresponding to the gap 46. A hook portion 63 is formed integrally with the flat plate portion 61 from along the left side thereof and first extends out from the back of the flat plate portion 61, and then returns parallel to the flat plate portion towards the aperture 62. Thus, the hook portion 63 defines an elongated hook which closely fits over and securely catches on the lip 34 of the left channel beam 30.

Figure 3:
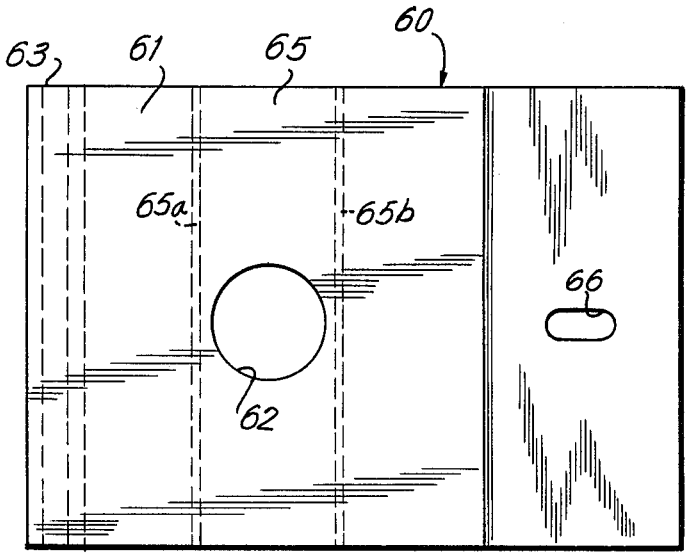
FIG. 3 is a plan view of the tie connector plate.

A table or raised spacer portion 65 is provided on the back of the flat plate portion 61 in the vicinity of the aperture 62. The table 65 has left and right edges **65*a* and 65*b* (FIG. 3) parallel to the hook portion 63 and the same distance apart as the length of the spacers 53. Once the connector plate 60 is in place on the waler 28, this table 65 locks the hook portion 63 on flange 32, acts to assist the spacers 53 in maintaining the channel beams 30 and 40 at the proper predetermined distance, helps to stiffen the waler 28 at the point maximum stress by tension tie rod 57, and also strengthens the plate 60 at the point where the tie rod nut 67** directly bears.

A bolt hole 66 is provided in the flat plate portion 61, near the right-hand edge and in the overhang beyond the position of the lip 44. This hole 66 serves as a fastening means used in the fastening of the connector 60 to the vertical waler 28. Thus, once the hook portion 63 is in place over the lip 34, the right hand side of the connector plate 60 can be coupled to the lip 44. Here, a bolt clip 48 positioned over the lip 44 is fastened to the connector plate 60 by means of a bolt 49 through the bolt hole 66, and secured in place by a lock washer 49' and nut 49''.

Of course, other conventional fastening means can be used in place of the bolt hole 66 and associated bolt clip 48 and bolt 49. For instance, an over-the-center toggle clamp could be used to clamp the flat plate portion 61 to the lip 44.

Finally, wing nut 67 secures the tie 57 in place on plate 60 against waler 28. In this embodiment, the wing nut 67 has a sufficiently broad base so as not to require a washer (especially in view of the raised spacer portion 65 of plate 61).

It is apparent that the connector plate 60 constructed according to this invention has a minimum of parts, and is extremely simple to install and to adjust once in place on a waler 28. In addition, it should be noted that the bolt clip 48 used to secure the connector plate 60 of the above-described embodiment of this invention is completely interchangeable with the bolt clips 48 that are used to connect the waler 28 to the aluminum joist 20. Furthermore, the joint 20 and clips 49 are standard equipment used also in horizontal shoring. Thus, the number of types of parts required is kept to a minimum. Also, the connector plate of this invention, particularly as described hereabove, adds to the structural strength of the vertical waler 28. Additionally, the connector plate 60 is preferably formed from extruded aluminum.

The terms front and back and the terms right and left used in the above-described embodiment serve to facilitate the description of the disclosed embodiment. However, the present invention is not limited to structure oriented in the fashion described above. Obviously, the connector plate 60 could as easily be installed with the hook portion 63 disposed at the right-hand side thereof.

Also, in appropriate circumstances, the walers could be disposed horizontally and alternatively used as strongbacks, and the connector plate 60 could be suitably oriented. Note that the joists may be oriented vertically with the walers used horizontally.

As best seen in FIG. 2, inwardly directed lip 63' of hook 63 is constructed to bear on the inner surface of flange 32 defined by lip 34 of channel 30. This is made possible by clearance trough 63'' which facilitates hooking the plate 60 onto the lip 34 at an angle to the flange 32 so that the plate 60 can then be swung into place without binding, thus positioning the spacer portion 65 between the channels 30, 40.

In the broader aspects of this invention, the waler 28 could be made from beams other than plain U-shaped channels. Instead, such channels could have at least bolt slots therein and the plate 60 could be fastened to the waler 28 by a single hook 63 and a single bolt 49, but with the latter secured in such a bolt slot rather than utilizing a clip 48. Alternatively, the parallel beams 30, 40 instead of being U-shaped channels, could be a pair of aluminum joists such as joist 23.

I claim:

1. A connector plate adapted to be mounted on the outer flanges of a pair of U-shaped channels joined in back-to-back spaced relation as a concrete forming waler, comprising a plate portion of a size adapted to overlie both said outer flanges from beyond the outside edge of one said flange to beyond the outside edge of said other outer flange, hook means at one edge of said plate adapted for securing said plate to the outer edge of one of said flanges, fastening means adapted for use in securing said plate to said other flange, a raised spacer portion formed in the bottom face of said plate and dimensioned to fit snugly in the gap between said channels when said plate is hooked in place on said waler, and a tie rod aperture through said plate substantially centered through said raised portion.

2. A connector plate according to claim 1, wherein said hook means is an integral hook portion formed along a substantial portion of one edge of said plate portion and dimensioned to fit closely over the outer edge of one of said outer flanges including any lip thereon.

3. A connector plate according to claim 2, wherein said raised spacer portion has edges extending parallel to said flanges and disposed on opposite sides of said aperture.

4. A connector plate according to claim 2, wherein said fastening means comprises at least a hole through said plate portion at a point adapted to be beyond said other outer flange when said plate is mounted on said waler such that a clip can be bolted therethrough to fasten said plate to said other flange.

5. A connector plate according to claim 4, further comprising lips inwardly directed on said flanges, and wherein said fastening means further comprises a clip removably bolted to said hole in said plate portion and having a hook portion thereon for engaging a lip on one of said flanges.

6. A connector plate according to claim 4, wherein said hook portion includes an inwardly directed hook lip dimensioned to bear against the inner surface of said one flange inclusive of any flange lip forming such inner surface, and wherein a clearance trough is formed in the plate portion adjacent said hook portion.

7. A connector plate according to one of claims 1 to 4 or 5, wherein said plate is formed of an extruded aluminum.

8. A wall form comprising a plurality of connector plates according to one of claims 1, 2, or 5, a panel, supporting joists affixed thereto, a plurality of said walers mounted across said joists and having said connector plate mounted thereon across said outer flanges thereof in predetermined positions adapted for receiving and cooperatively joining said wall form to tie rods in a wall form assembly.

9. A wall form according to claim 8, wherein said walers, said connector plates, and said joists are formed of extruded aluminum.

10. A wall form according to claim 9, further comprising means for joining the respective webs of said pair of channel members and spacing the same at a predetermined stabilizing distance, which latter means includes two longitudinally extending rows of bolt holes with bolts extending therethrough at predetermined intervals in said webs, and hollow spacers surrounding said bolts and separating said webs at said predetermined distance.

11. A wall form assembly comprising at least a pair of opposing wall forms according to claim 9, which wall forms are joined by tie rods through aligned connector plates on opposing walers of said respective wall forms, and nuts secured on either end of said tie rods to fix said wall forms in position.

12. A connector plate adapted to be mounted on the outer flanges of a pair of parallel beams fixed in spaced relation as a concrete forming waler, comprising an extruded aluminum plate portion of a size adapted to overlie both said outer flanges from beyond the outside edge of one said flange to beyond the outside edge of said other outer flange, hook means at one edge of said plate portion adapted for securing said plate to the outer edge of one of said flanges, raised spacer means formed in the bottom face of said plate and dimensioned to fit snugly in the gap between said channels when said plate is hooked in place on said waler, fastening means adapted for use in securing said plate to said other flange, and a tie rod aperture through said plate adapted to be substantially centered in the spacing between said beams said hook means having an inwardly directed hook lip dimensioned to bear against the inner surface of one of said flanges, and said plate portion having a clearance trough formed therein where the latter joins said hook means.

13. A connector plate adapted to be mounted on the outer flanges of a pair of parallel beams fixed in spaced relation as a concrete forming waler, comprising an extruded aluminum plate portion of a size adapted to overlie both said outer flanges from beyond the outside edge of one said flange to beyond the outside edge of said other outer flange, hook means at one edge of said plate portion adapted for securing said plate to the outer edge of one of said flanges, fastening means adapted for use in securing said plate to said other flange, and a tie rod aperture through said plate adapted to be substantially centered in the spacing between said beams said hook means having an inwardly directed hook lip dimensioned to bear against the inner surface of one of said flanges, and said plate portion having a clearance trough formed therein where the latter joins said hook means.

14. A connector plate according to claim 13 or claim 12, wherein said hook means is an integral hook portion formed along a substantial portion of one edge of said plate portion and dimensioned to fit closely over the outer edge of one of said outer flanges including any lip thereon.

15. A connector plate according to claim 14, wherein said fastening means consists of a bolt hole through said plate portion at a point adapted to be beyond said other outer flange when said plate is mounted on said waler such that a clip can be bolted therethrough to fasten said plate to said other flange.

* * * * *